US010337812B2

(12) United States Patent
Liao

(10) Patent No.: US 10,337,812 B2
(45) Date of Patent: Jul. 2, 2019

(54) ACTIVE MAGAZINE DISENGAGEMENT STRUCTURE

(71) Applicant: GUAY GUAY TRADING CO., LTD., Changhua County (TW)

(72) Inventor: Yin-Hsi Liao, Changhua County (TW)

(73) Assignee: GUAY GUAY TRADING CO., LTD., Changhua County (TW)

( * ) Notice: Subject to any disclaimer, the term of this patent is extended or adjusted under 35 U.S.C. 154(b) by 0 days.

(21) Appl. No.: 15/854,750

(22) Filed: Dec. 27, 2017

(65) Prior Publication Data

US 2018/0245867 A1 Aug. 30, 2018

(30) Foreign Application Priority Data

Feb. 24, 2017 (TW) ..... 106202734 A

(51) Int. Cl.
*F41A 9/59* (2006.01)
*F41A 9/65* (2006.01)

(52) U.S. Cl.
CPC . *F41A 9/59* (2013.01); *F41A 9/65* (2013.01)

(58) Field of Classification Search
CPC ..... F41A 9/59; F41A 9/65
See application file for complete search history.

(56) References Cited

U.S. PATENT DOCUMENTS

| | | | | |
|---|---|---|---|---|
| 5,379,541 | A * | 1/1995 | Bammate | F41A 9/59 42/18 |
| 9,097,474 | B1 * | 8/2015 | Zins | F41A 5/04 |
| 2016/0348992 | A1 * | 12/2016 | Tisone | F41A 9/59 |
| 2017/0234635 | A1 * | 8/2017 | Kim | F41A 9/59 89/190 |
| 2018/0149438 | A1 * | 5/2018 | Headrick | F41A 9/59 |

OTHER PUBLICATIONS

"Gun Review: Cobalt Kinetics Evolve: An Evolution of the AR", thefirearmblog.com, Dec. 20, 2015, pp. 3-4 (Year: 2015).*
"[SHOT 2018] Strike Industries—STRIKE MAG and Auto MagRelease", thefirearmblog.com, Jan. 22, 2018, pp. 1-2 (Year: 2018).*

* cited by examiner

*Primary Examiner* — Joshua T Semick
(74) *Attorney, Agent, or Firm* — Leong C. Lei

(57) ABSTRACT

An active magazine disengagement structure includes: a magazine body, adapted to be in engagement with at least one gun body; at least one trigger device, movably configured on the magazine body; at least one trigger device, movably configured on the magazine body, and positioned on one side of the trigger device and operated in coordination therewith; and at least one on-off device, movably configured on the magazine body, adapted to retain the magazine body with the gun body, and positioned on one side of the interlocking device and operated in coordination therewith to allow the magazine body to be separated from the gun body actively without any manual operation.

20 Claims, 7 Drawing Sheets

ACTIVE MAGAZINE DISENGAGEMENT STRUCTURE

(a) TECHNICAL FIELD OF THE INVENTION

The present invention relates to an active magazine disengagement structure, and more particularly to an active magazine disengagement structure, capable of allowing a magazine body to be actively separated from a gun body instead of a manual operation.

(b) DESCRIPTION OF THE PRIOR ART

To increase the photorealism of conventional toy guns or speed the bullet supplement thereof, they are always provided with a conventional magazine operated in coordination with a magazine unloading device. A conventional magazine unloading device, for example, includes an operating element movably configured on a gun body and at least one spring configured on one side of the operating element, with a conventional magazine being selectively retained through it. When the magazine is inserted into a gun body, it first pushes the operating element away to allow it to be moved and drives the spring to move to carry out energy storage. Thereafter, the spring will release energy to return the operating element to secure the magazine. Furthermore, the operating element is operated to move the magazine and make the spring store energy, thereby allowing the magazine to be separated from the operating element (the gun body), and the spring to return the operating element by releasing the operating element upon the disengagement of the magazine.

However, the replacement of a conventional magazine needs to operate the operating element such that the replacement speed is slower and a gun body will be moved, not conforming to use requirements when the magazine needs to be replaced faster or without moving the gun body (e.g. upon a shooting game).

SUMMARY OF THE INVENTION

The main object of the present invention is to provide an active magazine disengagement structure, allowing a magazine body to be separated from a gun body naturally after all bullets accommodated therein are fired completely.

To achieve the object mentioned above, the present invention proposes an active magazine disengagement structure, including: a magazine body, adapted to be in engagement with at least one gun body; at least one trigger device, movably configured on the magazine body; at least one trigger device, movably configured on the magazine body, and positioned on one side of the trigger device and operated in coordination therewith; and at least one on-off device, movably configured on the magazine body, adapted to retain the magazine body with the gun body, and positioned on one side of the interlocking device and operated in coordination therewith to allow the magazine body to be separated from the gun body actively.

Therefore, the on-off device will first secure the magazine body with the gun body for follow-up bullet firing when the magazine body is in engagement with the gun body, and the trigger device will be moved with the bullet firing. The trigger device will drive the interlocking device to move when all the bullets are fired completely, and the interlocking device is then operated in coordination with the on-off device, allowing the interlocking device to be released from the gun body so that the magazine body will be subject to gravity to be separated from the gun body. With the above technologies, the present invention can omit a manual magazine replacement action, allowing the magazine body to be separated from a gun body actively, thereby overcoming the defects of conventional magazines of the replacement speed being slower and the gun body being moved upon magazine replacement.

DETAILED DESCRIPTION OF THE PREFERRED EMBODIMENTS

Figure 1:
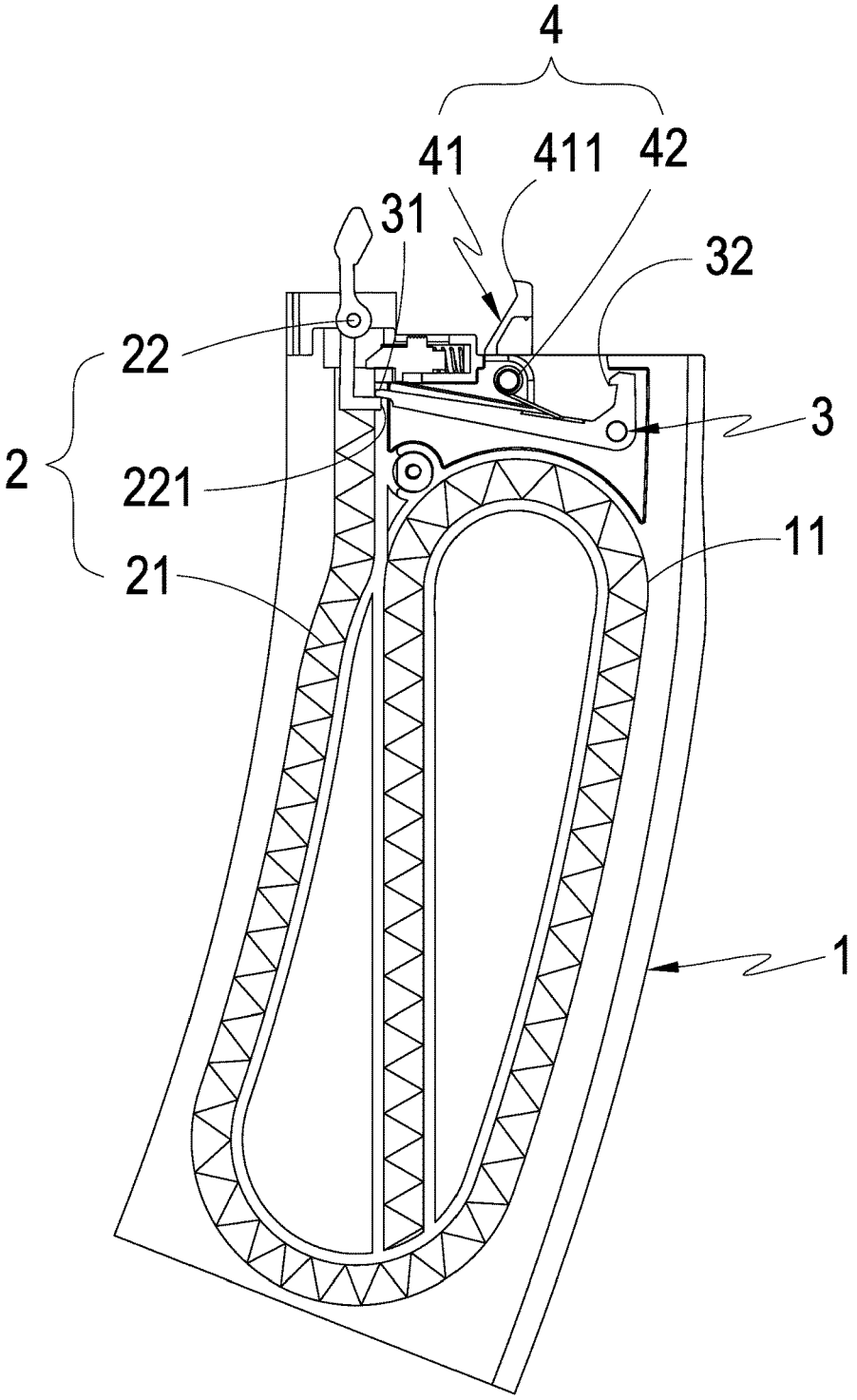
FIG. 1 is a schematic view of a preferred embodiment of the present invention.
Figure 2:
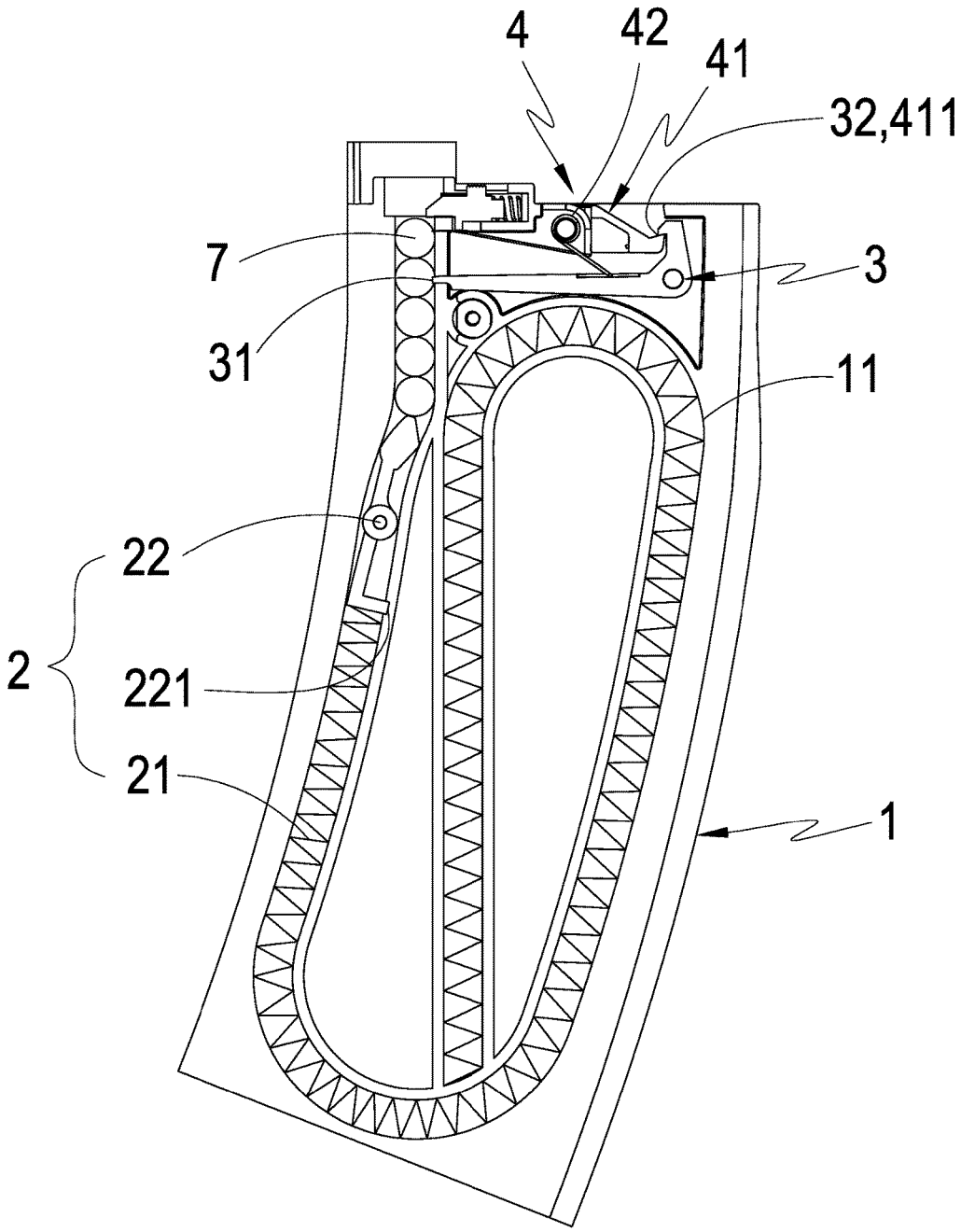
FIG. 2 is a schematic view of the embodiment of the present invention in implementation.
Figure 3:
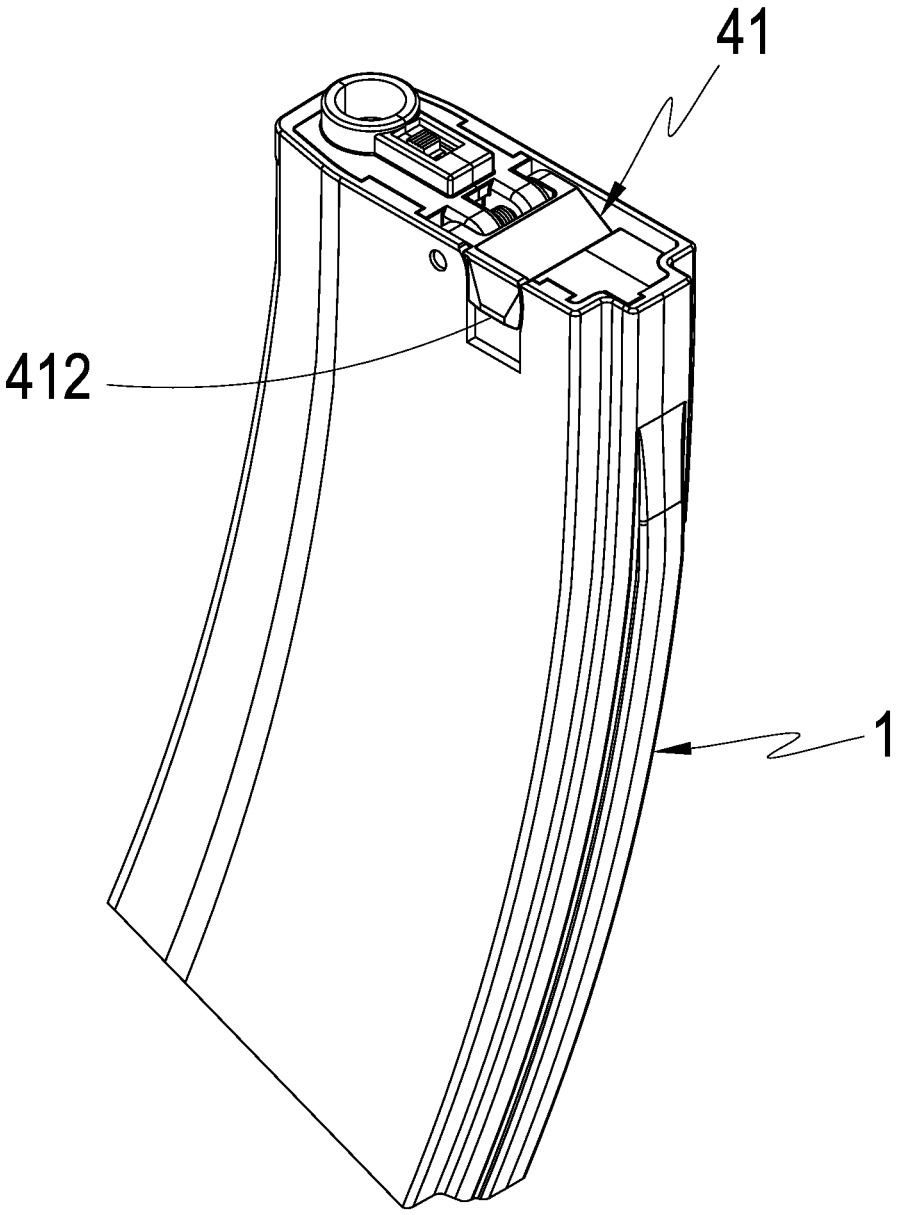
FIG. 3 is a perspective view of the embodiment of the present invention in implementation.
Figure 4:
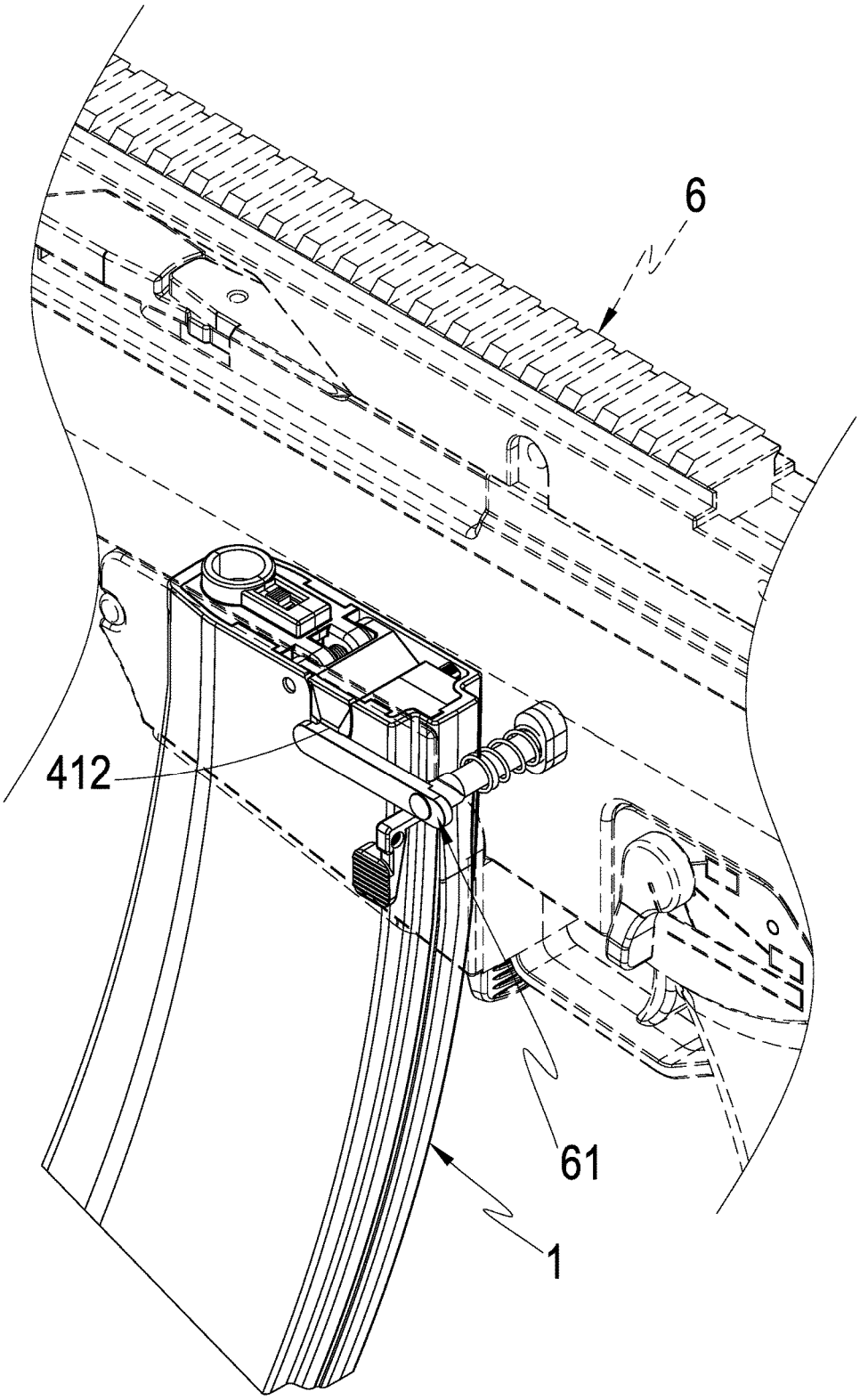
FIG. 4 is a schematically perspective view of the embodiment of the present invention secured to a gun body.

Referring to FIGS. 1 to 4, an active magazine disengagement structure of the present invention includes a magazine body 1, at least one trigger device 2, at least one interlocking device 3, and at least one on-off device 4, where the magazine body 1 has at least one bullet accommodation track 11 adapted to accept a plurality of bullets 7 and allows the engagement of at least one gun body 6 (for clarity, the internal structure of the gun body is omitted in the figures) having at least one magazine unloading device 61 therewith.

The trigger device 2 is movably configured on the magazine body 1 and adapted to press against the bullets 7, including at least one bullet pushing elastic body 21 configured inside the bullet accommodation track 11, and at least one rammer 22 movably configured on the bullet accommodation rack 11 and positioned on one end of the bullet pushing elastic body 21, where the rammer 22 has at least one contact portion 221 selectively in touch with the interlocking device 3 and driving it to move.

The interlocking device 3 is movably configured on the magazine body 1, positioned on one side of the trigger device 2 and operated in coordination therewith, where at least one interlocking portion 31 selectively in touch with the contact portion 221 is configured on one side of the interlocking device 3, and at least one fastening portion 32 on one end of the interlocking device 3.

The on-off device 4 is movably configured on the magazine body 1 and adapted to secure the magazine body 1 with the gun body 6, where the on-off device 4 is positioned on one side of the interlocking device 3 and operated in coordination therewith, thereby allowing the magazine body 1 to be actively separated from the gun body 6. Furthermore, The on-off device 4 includes at least one engagement device 41 movably configured on the magazine body 1 and at least one elastic element 42 in connection with the engagement device 41 for the provision of action power, where one end of the elastic element 42 is pressed against the interlocking device 3 to drive it to move, and one side of the engagement device 41 is configured with at least one buckle portion 411 corresponding to the fastening portion 32 of the interlocking device 3, where the buckle portion 411 is selectively fastened by the fastening portion 32. Furthermore, one side of the engagement device 41 has at least one positioning portion 412 shaped correspondingly to the magazine unloading device 61, and the magazine unloading device 61 is adapted to secure the magazine body 1 with the positioning portion 412, but the present invention is not so limited.

Referring to FIGS. 1 to 6, a plurality of bullets 7, upon implementation, are accepted in the bullet accommodation track 11 of the magazine body 1, the rammer 22 of the trigger device 2 is driven to move, the bullet pushing elastic body 21 is caused to deform and thus store energy, and the buckle portion 411 of the engagement device 41 of the on-off device 4 is ascertained to be in engagement with the fastening portion 32 of the interlocking device 3. At this time, the engagement device 41, interlocking device 3 are fastened together accurately through the elastic element 42. Thereafter, the magazine body 1 is in engagement with the gun body 6. At this time, the magazine unloading device 61 will secure the magazine body 1 with the positioning portion 412 of the engagement device 41 for follow-up firing.

Figure 5:
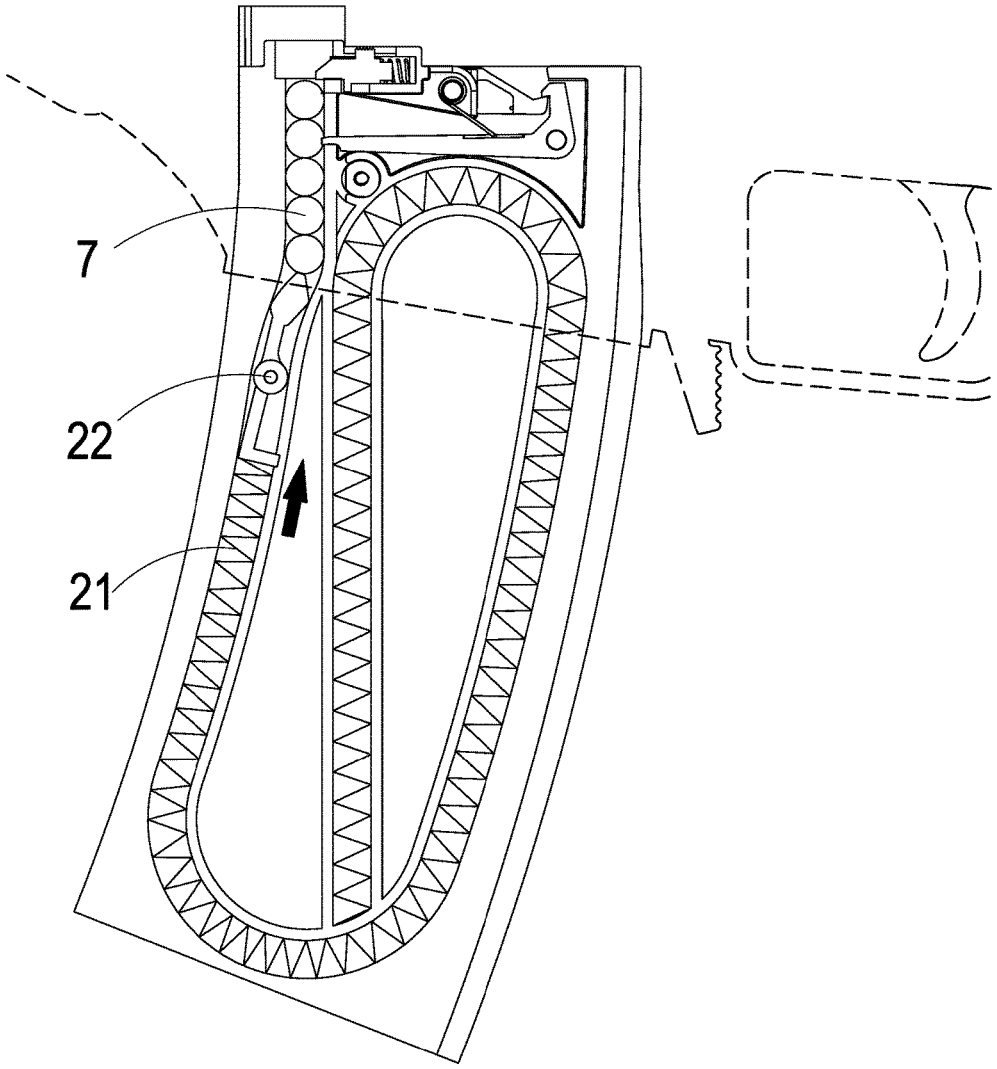
FIG. 5 is a schematic view of the embodiment of the present invention in an action state.
Figure 6:
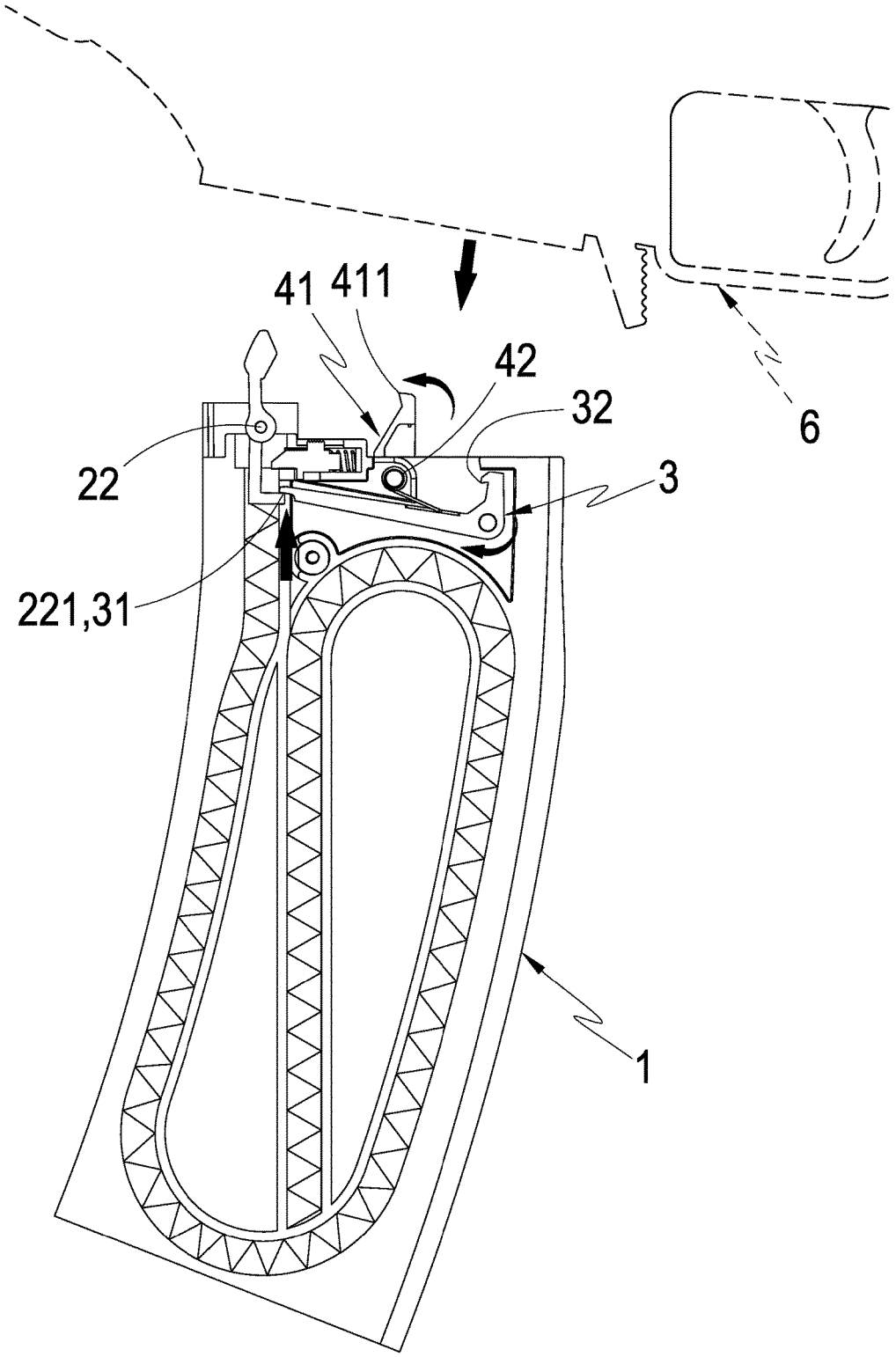
FIG. 6 is a schematic view of the embodiment of the present invention separated from the gun body actively.

Referring to FIGS. 5 and 6, the number of the bullets 7 will be reduced with the firing action during firing, and the bullet pushing elastic body 21 will release energy to move the rammer 22 to push the bullets 7 to be fired, and the contact portion 221 will touch the interlocking portion 31 of the interlocking device 3 and drive it to move after all the bullets 7 are fired completely, and further drives the fastening portion 32 to cause it to be separated from the buckle portion 411 to release the engagement of the fastening portion 32 with the buckle portion 411. Furthermore, the engagement device 41 is subject to the elastic force of the elastic element 42 to move. As a result, the magazine body 1 are not retained by the positioning portion 412 and magazine unlocking device 61 any more so that the magazine body 1 will be subject to gravity and separated from the gun body 6 actively, which can omit the manual action of operating the magazine device 61 to release the magazine body 1, thereby improving the replacement speed of the magazine body 1 and reducing the amount of the movement of the gun body 6 upon the replacement of the magazine body 1.

Figure 7:
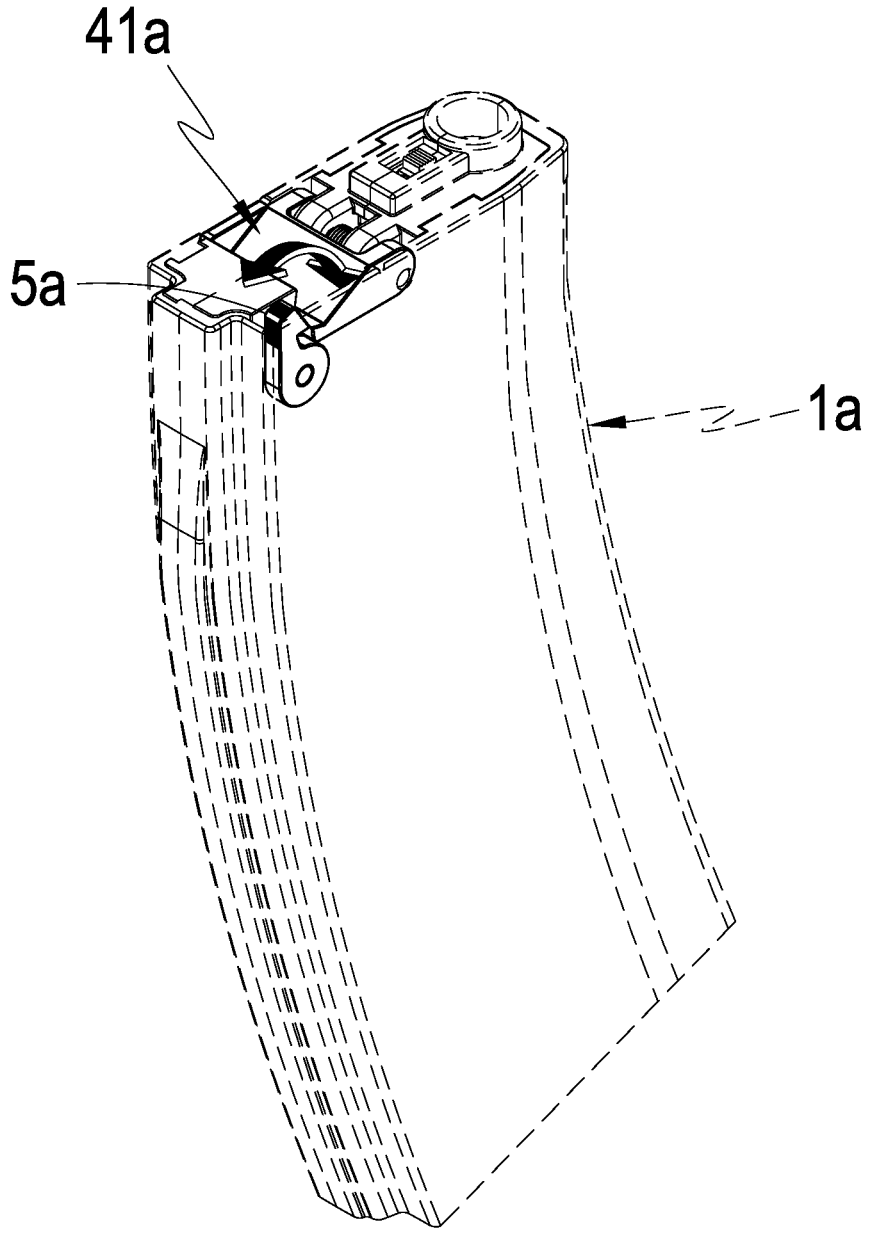
FIG. 7 is a schematically perspective view of another embodiment of the present invention with a switching device.

Referring to FIG. 7, which shows another preferred embodiment of the present invention, the present embodiment is almost similar to the above embodiment except at least one switching device 5*a* is movably configured inside a magazine body 1*a* in the present embodiment, where the switching device 5*a* is configure on one side of an engagement device 41*a* and adapted to selectively retain the engagement device 41*a* so that a user may operate the switching device 5*a* to selectively retain the engagement device 41*a*; the magazine body 1*a* will be separated from the gun body automatically after all the bullets are fired complete when the switching device 5*a* does not retain the engagement device 41, but the magazine body 1*a* will still be retained on the gun body 1*a* after all the bullets are fired completely when the switching device 5*a* retains the engagement device 41*a* so that the magazine body 1*a* can be separated from the gun body only by further operating the magazine unlocking device manually (e.g. as the replacement action of conventional magazines mentioned above), thereby allowing the user to have two choices to do magazine body replacement.

Therefore, the present invention has advantages over the prior arts as the following:

1. the present invention can omit manual action to allow the magazine body 1 to be separated from the gun body 6 actively by operating the magazine body 1, trigger device 2, interlocking device 3 and on-off device 4 in coordination with one another; and
2. the present invention can achieve both manual and automatic replacements of the magazine body 1 as one's will by retaining the engagement device 41*a* selectively with the switching device 5*a*.

I claim:

1. A magazine disengagement structure for a magazine body having a trigger device configured to move a bullet therein, comprising:

an interlocking device in said magazine body, wherein said interlocking device has an interlocking portion configured to be pushed by said trigger device to rotate said interlocking device about a first axis; and an on-off device at a top of said magazine body, wherein said on-off device has a buckle portion configured to engage with a fastening portion of said interlocking device at a higher level than said interlocking portion of said interlocking device, wherein said interlocking device is configured to rotate about said first axis to release said buckle portion from said fastening portion.

2. The structure of claim 1, wherein said fastening portion is at an end of a portion of said interlocking device upwards extending from said first axis.

3. The structure of claim 1, wherein said interlocking portion is at an end of a portion of said interlocking device laterally extending from said first axis.

4. The structure of claim 1, wherein said on-off device comprises an engagement device at said top of said magazine body and an elastic element configured to rotate said engagement device about a second axis, wherein said interlocking device is configured to rotate about said first axis to release said buckle portion from said fastening portion to rotate said engagement device about said second axis by an elastic force of said elastic element.

5. The structure of claim 4, wherein said interlocking device is configured to rotate about said first axis in a clockwise direction to release said buckle portion from said fastening portion to rotate said engagement device about said second axis in a counterclockwise direction by said elastic force of said elastic element.

6. The structure of claim 1, wherein said fastening portion is shaped like a hook having a bottom surface configured to engage with said buckle portion, wherein said buckle portion has a top surface configured to contact with said bottom surface of said fastening portion.

7. The structure of claim 1, wherein said interlocking portion has a bottom surface configured to be in touch with said trigger device.

8. A magazine disengagement structure for a magazine body having a trigger device configured to move a bullet therein, comprising:

an interlocking device in said magazine body, wherein said interlocking device has an interlocking portion configured to be pushed by said trigger device to rotate said interlocking device about a first axis; and an on-off device comprising an engagement device at a top of said magazine body, wherein said engagement device has a buckle portion configured to engage with a fastening portion of said interlocking device, wherein said interlocking device is configured to rotate about said first axis to release said buckle portion from said fastening portion to rotate said engagement device about a second axis.

9. The structure of claim 8, wherein said fastening portion is at an end of a portion of said interlocking device upwards extending from said first axis.

10. The structure of claim 8, wherein said interlocking portion is at an end of a portion of said interlocking device laterally extending from said first axis.

11. The structure of claim 8, wherein said on-off device comprises an elastic element configured to rotate said engagement device about said second axis, wherein said interlocking device is configured to rotate about said first axis to release said buckle portion from said fastening portion to rotate said engagement device about said second axis by an elastic force of said elastic element.

12. The structure of claim 11, wherein said elastic element has an end pressed against said interlocking device.

13. The structure of claim 8, wherein said interlocking device is configured to rotate about said first axis in a clockwise direction to release said buckle portion from said fastening portion to rotate said engagement device about said second axis in a counterclockwise direction.

14. The structure of claim 8, wherein said fastening portion is shaped like a hook having a bottom surface configured to engage with said buckle portion, wherein said buckle portion has a top surface configured to contact with said bottom surface of said fastening portion.

15. A magazine disengagement structure for a magazine body having a trigger device configured to move a bullet therein, comprising:

an interlocking device in said magazine body, wherein said interlocking device has an interlocking portion configured to be pushed by said trigger device to rotate said interlocking device about a first axis; and an on-off device at a top of said magazine body, wherein said on-off device has a buckle portion configured to engage with a fastening portion of said interlocking device, wherein said fastening portion is at an end of a first portion of said interlocking device upwards extending from said first axis, wherein said interlocking device is configured to rotate about said first axis to release said buckle portion from said fastening portion.

16. The structure of claim 15, wherein said interlocking portion is at an end of a second portion of said interlocking device laterally extending from said first axis.

17. The structure of claim 15, wherein said fastening portion is shaped like a hook having a bottom surface configured to engage with said buckle portion, wherein said buckle portion has a top surface configured to contact with said bottom surface of said fastening portion.

18. The structure of claim 15, wherein said interlocking portion has a bottom surface configured to be in touch with said trigger device.

19. The structure of claim 15, wherein said on-off device comprises an engagement device at said top of said magazine body and an elastic element configured to rotate said engagement device about a second axis, wherein said interlocking device is configured to rotate about said first axis to release said buckle portion from said fastening portion to rotate said engagement device about said second axis by an elastic force of said elastic element.

20. The structure of claim 19, wherein said interlocking device is configured to rotate about said first axis in a clockwise direction to release said buckle portion from said fastening portion to rotate said engagement device about said second axis in a counterclockwise direction by said elastic force of said elastic element.

* * * * *